US010040594B2

(12) United States Patent
Sytema

(10) Patent No.: US 10,040,594 B2
(45) Date of Patent: Aug. 7, 2018

(54) BLANK FOR A BOX, ASSEMBLY OF A BLANK AND A TAPE FOR A BOX AND A BOX FORMED FROM SUCH BLANK AND/OR SUCH ASSEMBLY

(71) Applicant: NEOPOST TECHNOLOGIES, Bagneux (FR)

(72) Inventor: Herman Sytema, Terhorne (NL)

(73) Assignee: NEOPOST TECHNOLOGIES, Bagneux (FR)

( * ) Notice: Subject to any disclaimer, the term of this patent is extended or adjusted under 35 U.S.C. 154(b) by 270 days.

(21) Appl. No.: 14/418,782

(22) PCT Filed: Jul. 31, 2013

(86) PCT No.: PCT/IB2013/056302

§ 371 (c)(1),
(2) Date: Jan. 30, 2015

(87) PCT Pub. No.: WO2014/020559

PCT Pub. Date: Feb. 6, 2014

(65) Prior Publication Data

US 2015/0197364 A1 Jul. 16, 2015

(30) Foreign Application Priority Data

Jul. 31, 2012 (EP) ..... 12178695

(51) Int. Cl.
*B65D 5/02* (2006.01)
*B65D 5/20* (2006.01)

(52) U.S. Cl.
CPC ..... *B65D 5/0236* (2013.01); *B65D 5/0227* (2013.01); *B65D 5/2052* (2013.01)

(58) Field of Classification Search
CPC .. B65D 5/0236; B65D 5/0227; B65D 5/2052; B65D 5/10

(Continued)

(56) References Cited

U.S. PATENT DOCUMENTS 2,496,043 A * 1/1950 Farrell ..... B65D 5/40 229/125.34
3,221,974 A * 12/1965 Scholle ..... B65D 5/0227 229/117.33

(Continued)

FOREIGN PATENT DOCUMENTS

| | | |
|---|---|---|
| DE | 20 2005 002 860 U1 | 4/2005 |
| FR | 2 861 370 A1 | 4/2005 |
| GB | 1 248 131 A | 9/1971 |

OTHER PUBLICATIONS

International Search Report of PCT/IB2013/056302 dated Dec. 13, 2013.

(Continued)

*Primary Examiner* — Christopher Demeree
(74) *Attorney, Agent, or Firm* — Seed IP Law Group LLP

(57) ABSTRACT

A blank for folding a box is proposed that allows folding a box of which the only seams substantially parallel to a bottom and a top plane of the box are a seam for attaching a first side panel to a first top side panel, a seam for attaching a second side panel to a second top side panel, and a seam for attaching a top end panel to a second end panel so that the seams are formed on an external surface of the box and are situated at a same distance from the bottom panel. A corresponding blank has a rectangular bottom panel (41), a first rectangular side panel (42) joined to a first side of said bottom panel (41), a second rectangular side panel (43) joined to a second side of said bottom panel (41) opposite the first side thereof, a first rectangular end panel (44) joined to a first end of said bottom panel (41), a second rectangular end panel (45) joined to a second end of said bottom panel (41) opposite the first end of said bottom panel (41) and having a free end side opposite said second end of said bottom panel (41), a first rectangular corner panel (46) joined to a first side of said first end panel (44), a second rectangular corner panel (48) joined to a second side of said first end panel (44) opposite the first side thereof, a third rectangular corner panel (47) joined to a first side of said (Continued)

second end panel (45), a fourth rectangular corner panel (49) joined to a second side of said second end panel (45) opposite the first side thereof, a rectangular top panel (50) joined to said first end panel (44) such that it is arranged at the side of said first end panel (44) opposite to the side where said bottom panel (41) is joined to said first end panel (44), a first rectangular top side panel (51) joined to a first side of said top panel (50), a second rectangular top side panel (52) joined to a second side of said top panel (50) opposite the first side thereof, and a rectangular top end panel (53) joined to said top panel (50) such that it is arranged at the side of said top panel (50) opposite to the side where said first end panel (44) is joined to said top panel (50), wherein said top side panels (51, 52) each have a width (H2+t) that substantially corresponds to the half of the length (H+2t; H+t) of each of the first and the second end panels (44; 45) and wherein said top end panel (53) has a length (H2+t) that substantially corresponds to the half of the length (H+2t; H+t) of each of the first and the second end panels (44; 45).

20 Claims, 11 Drawing Sheets

(58) Field of Classification Search
USPC ..... 229/132, 126, 125.39, 193, 110
See application file for complete search history.

(56) References Cited

U.S. PATENT DOCUMENTS

| | | | | |
|---|---|---|---|---|
| 3,237,841 | A * | 3/1966 | Ridgeway, Jr. | B65D 5/28 229/120.09 |
| 3,441,194 | A * | 4/1969 | Kistner | B65D 5/18 229/121 |
| 4,308,712 | A | 1/1982 | Hagedorn | |
| 4,447,002 | A * | 5/1984 | Kistner | B65D 5/0227 229/100 |
| 4,534,753 | A * | 8/1985 | Kistner | B65D 5/0227 493/453 |
| 7,090,115 | B2 * | 8/2006 | Pierce | B65D 77/065 229/109 |
| 2014/0367460 | A1 * | 12/2014 | Pettersson | B31B 1/00 229/123.1 |

OTHER PUBLICATIONS

International Fibreboard Case Code, also known as FEFCO-ESBO code, 11th edition, 2007, Published by FEFCO, Belgium.

* cited by examiner

BLANK FOR A BOX, ASSEMBLY OF A BLANK AND A TAPE FOR A BOX AND A BOX FORMED FROM SUCH BLANK AND/OR SUCH ASSEMBLY

TECHNICAL FIELD OF INVENTION

The invention relates to a blank for a box, in particular for automatically folding a box from said blank. The invention also relates to an assembly of a blank and a tape for a box and a box formed from such blank respectively such assembly.

BACKGROUND OF THE INVENTION

Blanks for boxes having

- a rectangular bottom panel, a first rectangular side panel joined to a first side of said bottom panel,
- a second rectangular side panel joined to a second side of said bottom panel opposite the first side thereof,
- a first rectangular end panel joined to a first end of said bottom panel,
- a second rectangular end panel joined to a second end of said bottom panel opposite the first end of said bottom panel and having a free end side opposite said second end of said bottom panel,
- a first rectangular corner panel joined to a first side of said first end panel,
- a second rectangular corner panel joined to a second side of said first end panel opposite the first side thereof,
- a third rectangular corner panel joined to a first side of said second end panel,
- a fourth rectangular corner panel joined to a second side of said second end panel opposite the first side thereof,
- a rectangular top panel joined to said first end panel such that it is arranged at the side of said first end panel opposite to the side where said bottom panel is joined to said first end panel,
- a first rectangular top side panel joined to a first side of said top panel,
- a second rectangular top side panel joined to a second side of said top panel opposite the first side thereof, and
- a rectangular top end panel joined to said top panel such that it is arranged at the side of said top panel opposite to the side where said first end panel is joined to said top panel, are well known in the art, for example from the International Fibreboard Case Code, also called the FEFCO-ESBO code, 11th Edition, 2007. In this code, different blanks for folding boxes are specified. Subsection 0400 of this code shows "folder-type boxes", i.e. boxes, which are completely formed by folding special blanks and closing them in particular by gluing or taping. Under code 0410 a box of the type having panels is listed above is shown. Blanks of this type are particularly suited for automatically folding boxing at automated packaging stations. Similar blanks are shown in DE 20 2005 002 860 U1.

With these blanks, the height of the boxes is defined by the lengths of the first and second end panels, the length being the dimension of said panels seen perpendicular to the side, along which they are joined to the bottom panel. Upon folding the box, the first and second end panels are folded upwardly along the sides, along which they are joined to the bottom panel so that their respective length defines the height of the box. The top panel will be folded along the side, along which it is joined to the first end panel towards the free end side of the second end panel.

In the boxes known from the documents mentioned above, the length of the top end panel (the length being seen in the same direction as the length of the first and second end panels) and the widths of the first and second side panels as well as the widths of the first and second top side panels (the width being the dimension of the panels perpendicular to the length) are all approximately the same, which leads to very stable boxes. However, if a box is folded from such blank, the free end sides of the first and second top side panels and the top end panel terminate approximately along three sides of the bottom panel forming a slot between the respective free end sides and the bottom panel, which is difficult to cover with a sealing tape, since such tape would have to be folded by approximately 90° to run in part over the top end panel, the first and second top side panels and the bottom panel.

U.S. Pat. No. 4,308,712 discloses a blank, in which the widths of the first and second side panels and the first and second top side panels are approximately half of the length of the first and second end panels so that after folding them to a box they form a slot between them in approximately the middle of the height of the box. In order to provide sufficient stability, the blank is provided with an "inner" end panel that is joined to the second end panel along the side opposite to the side, along which the second end panel is joined to the bottom panel, so that this inner end panel can be folded such that it extends substantially parallel to the bottom panel and the top panel can rest on this inner panel.

However, in order to allow best access to the inside of the box, the inner panel should not be folded before items are put into the box. Moreover, while the first and second side panels and the first and second top side panels in the folded box meet along lines running approximately parallel to the bottom panel in approximately half of the height of the box, a slot is defined between the free end side of the top panel and the line, along which the inner panel is folded from the second end panel towards the inside making it difficult to cover such slot with a sealing tape. A similar blank is shown in GB 1 248 131, in which the second end panel again is provided with an "inner panel" that has to be folded towards the inside of the box, making an additional folding operation necessary and delimiting the access to the inside of the Box.

FR 2 861 370 shows a blank, in which the first and second end panels and the top side panel all have approximately the same length corresponding to the height of the folded box. The first and second side panels and the first and second top side panels have a width of more than half of the height of the folded box but less in the total height, in order to allow an overlap between the first side panel and the first topside panel respectively between the second side panel and the second top side panel, which are provided with means for sticking them together, allowing a certain minimum stability which for the purpose of these type of boxes is sufficient, since they are not intended for sending items but for transporting pastries from a bakery shop to one's home.

SUMMARY OF THE INVENTION

It is an object of the invention to provide a blank as set out above allowing to fold boxes thereof having not only sufficient stability and maximum accessibility towards the inside of the box but being able to be easily sealed by a tape. In particular, the blank should be easy to cut out from corresponding material in particular in a fully automated way at automated packaging stations forming customized boxes for items to be packaged. The blank should not only allow that the box is automatically folded but that the box is automatically sealed by a tape.

Another object of the invention is to provide an alternative assembly of a blank for a box and a tape. It is a further object of the invention to provide an assembly of a blank for a box and a tape from which a box can be formed which can relatively easily be sealed by means of said tape. It is a further object of the invention to provide an assembly of a blank for a box and a tape from which a box can be formed which when sealed by means of said tape can be transported with a relative low risk of unwanted opening. Another object of the invention is to provide a blank for a box, from which relatively easy a box can be folded around articles to be packaged in an automated way. Once articles are put in the box, the box design should allow automated closing and sealing of the box by a tape.

These and other objectives are achieved by a blank according to any one of the independent claim. At least one of the dependent claims defines an assembly of a blank according to the invention and a tape, said assembly being particularly suited for automated packaging stations forming boxes and in particular customized boxes for packaging items for shipping. At least one the dependent claims defines box formed from an assembly according to the invention. The respective dependent claims define advantageous embodiments of the respective independent claims.

The invention is based on the insight that the drawbacks of the known blanks mentioned above are at least partly the result of the fact that the seam of a box folded from the blank is situated at an edge of the box. Sealing this box at said edge by tape requires that the tape—if provided in a direction parallel to the edge—has to be folded around the edge, or—in case the tape is applied transverse to the extending direction of the edge—a plurality of pieces of tape has to be applied next to each other. In both cases the application of tape to seal the box is relatively complex, which is especially a disadvantage in case of automated sealing. Furthermore, since during handling and transport edges of a box formed out of the known blank are most prone to impact, in some cases the tape may tear during transport or handling of the box resulting in the unwanted opening of the erected box. Especially when the seam of the box folded from the known blank is situated at the bottom, tearing of the tape can occur easily.

The invention has the great advantage that the blanks proposed for folding a box allow folding a box of which the only seams substantially parallel to a bottom and a top plane of the box are a seam for attaching a first side panel to a first top side panel, a seam for attaching a second side panel to a second top side panel, and a seam for attaching a top end panel to a second end panel so that the seams are formed on an external surface of the box and are situated at a same distance from the bottom panel, which seams than can easily be closed by a tape wound around the box in a fully automated fashion. Also folding and even cutting of the blanks can be performed fully automated by a machine for automated packaging of items to be sent.

According to the invention at least one of the objects mentioned above is achieved by providing an assembly of a blank for a box and a tape used for sealing the box, wherein said blank comprises a rectangular bottom panel, a first rectangular side panel joined to a first side of said bottom panel, a second rectangular side panel joined to a second side of said bottom panel opposite the first side thereof, a first rectangular end panel joined to a first end of said bottom panel, a second rectangular end panel joined to a second end of said bottom panel opposite the first end of said bottom panel, a first rectangular corner panel joined to a first side of said first end panel, a second rectangular corner panel joined to a second side of said first end panel opposite the first side thereof, a third rectangular corner panel joined to a first side of said second end panel, a fourth rectangular corner panel joined to a second side of said second end panel opposite the first side thereof, a rectangular top panel joined to said first end panel such that it is arranged at the side of said first end panel opposite to the side where said bottom panel is joined to said first end panel, a first rectangular top side panel joined to a first side of said top panel, a second rectangular top side panel joined to a second side of said top panel opposite the first side thereof, and a rectangular top end panel joined to said top panel such that it is arranged at the side of said top panel opposite to the side where said first end panel is joined to said top panel, said bottom panel having a length of about L+2t and a width of about W+4t, said side panels each having a length ranging from about L to about L+2t and a width of about H1+t, said end panels each having a width of about W+2t, said first end panel having a length of about H+2t, said second end panel having a length of about H+t, said top panel having a length of about L+3t and a width of about W+4t, said top side panels having a length ranging from about L+t to about L+3t and a width of about H2+t, said top end panel having a length of about H2+t and a width between about W+2t and about W+4t, wherein $L \geq H1$, $L \geq H2$, and $H-H1 \geq \frac{1}{2}B$ and/or $H-H2 \geq \frac{1}{2}B$, wherein L is the inside length of the box to be folded from the blank, W is the inside width of the box to be folded from the blank and H is the inside height of the box to be folded from the blank, B is the breadth of the tape, T is the thickness of the blank, and t is a tolerance value satisfying the relation $0 \leq t \leq 2T$. The tolerance value t defines a tolerance with regard to the height, width and length of the panels of the blank, which dimensions due to the tolerance value may deviate a small amount depending on the material of which the blank is made and taking account of cutting, creasing and folding properties. In particular in case the material is relatively thick compared to the box size (typically when the thickness is more than 1% of the length, width or height of the box), it is preferred that t is approximately equal to T, i.e. the thickness of the blank.

In the assembly in accordance with the invention $H-H1 \geq \frac{1}{2}B$ and/or $H-H2 \geq \frac{1}{2}B$, such that after folding of the box the seam of the box is positioned at a distance of at least ½B from the edge of the box. In addition, a box can be obtained in which the horizontal seams are neatly arranged along one line around the external contour of the box, in a plane substantially parallel to the bottom and top plane of the assembled box. This makes it possible to easily apply a tape at least approximately centered with respect to the seam in a direction parallel to the seam, since the tape can be applied completely in a flat arrangement. Furthermore, the sealing tape does not extend over the top or bottom edges of the erected box, making it less prone to impact and tear and wear during handling and transport. Key in the invention is that the width of the side panels relates to the height of the box, and that the breadth B of the tape defines the minimum dimensions of the blank, in order to obtain a box that has seams along three exterior sides of the box, at a constant height with respect to the bottom plane of the assembled box, in which said height is such that the ease of closing and opening of the box are improved while the risk of untimely opening is reduced.

According to a further aspect of the invention, at least one of the objects identified above is achieved by providing an assembly of a blank for a box and a tape used for sealing the box as described before, but in which said top panel has a length of about L+3t and a width between about W+4t and about W+6t, said top side panels has a length ranging from about L+t to about L+3t and a width between about H2 and about H2+t, said top end panel has a length of about H2+t and a width between about W+2t and about W+4t, said blank further comprising a first rectangular top corner panel joined to a first side of said top end panel and a second rectangular top corner panel joined to a second side of said top end panel opposite the first side thereof, said top corner panels each having a length of about H2 and a width between about H2 and about H2+2t.

In an embodiment of a blank according to the invention, said corner panels each have a length of about H. Preferably said corner panels each have a width of about H1+2t. Such a length of said corner panels is advantageous since, when folding them at the inside of the box, the height equals the internal height of the box, so that these corner panels act as a support between the bottom and top panel and thus give additional strength to the box which is beneficial during the assembly of the box, especially when this is done in an automated way, and which is also beneficial for handling the assembled box, since this improves protection of the contents.

In an advantageous embodiment of a blank according to the invention H1=H2. In this manner the blank can be manufactured easily since the circumference of the complete blank is at least substantially rectangular. In a preferred embodiment then H1=H2=½H, such that it is possible to fold the blank in such a manner that the free edges of the side panels and the free edge of the respective top side panels are abutting each other or—depending on tolerances due to cutting and folding—are situated at a small distance from each other, such that after application of the tape the tapes lies in one flat surface upon the side panels.

In an alternative embodiment of a blank according to the invention either H1=½H+D or H2=½H+D, such that after folding the respective side panels overlap each other with a distance D. This provides an improvement of the protection of items packaged within the box, but the circumference of the complete blank is not rectangular any more, which could lead to additional steps of manufacturing the blank.

In an advantageous embodiment of a blank according to the invention H1=½H+D and H2=½H+D, such that after folding the respective side panels overlap each other with a distance 2D, leading to an improvement of the protection of items packaged within the box, wherein D<6 cm, preferably D is at least about 1 cm, and most preferably at least about 3 cm. In this manner, protection of items packaged within the box is improved while using a relatively low amount of material for manufacturing the blank. Furthermore, since the top side panels overlap the side panels with an amount of D or 2D, it is ensured that opening of the box by breaking the tape, e.g. with a knife, does not damage the items packaged inside the box. Please note, that also with the overlap the seam of the box which is to be sealed by the tape, is still positioned at a distance of at least ½B from the top and bottom edges of the box.

In a further embodiment of a blank according to the invention, wherein the blank is made of cardboard having a thickness T and wherein respective panels of the blank, which are directly joined to each other, are joined by folding lines, and wherein indirectly joined neighboring panels are separated by cut-outs, the cut-outs have a length G (measured in longitudinal direction of the blank) with a value ranging between 0 and about 4T, preferably having a value of about 2T. For relatively thin and flexible blank material, the cut-out length may be 0, which simplifies the cutting process and limits the amount of generated waste material, in other cases wider cut-outs, up to 4T may be preferred to ease automated manufacturing of the box from the blank. Most preferably, the cut-out length is about 2T, in this manner sufficient material is cut out during manufacturing of the blank, which makes it possible to correctly fold the blank into a box without compromising the blank too much to obtain a strong box.

In an embodiment of the blank according to the invention, the blank is rectangular, which means that, apart from the cut-outs between the side and corner panels, the outside contour of the blank having a rectangular shape. In this manner a blank can be manufactured easily.

It should be understood that the most advantageous embodiment can differ from situation to situation, depending on the type of products to be packaged, on the desired level of protection for the items in the box, on the sizes of the box, the thickness and stiffness of the blank material, automation aspects and customer preferences.

In case the material is relatively stiff (e.g. due to its thickness), it is preferred that each of the folding lines connecting neighboring panels are formed of a number of parallel score lines, preferably two or three parallel score lines, which are spaced at a mutual distance of t", so that it is possible to compensate for this stiffness and for possible tolerances in dimensions and thickness of the material from which the blank is manufactured. In addition or alternatively, it is possible to realize such compensation in that the folding lines between separate panels are staggered with respect to each other, i.e. are not in line with each other. For example, the folding line between the bottom panel and the second side panel is not in line with the folding line between the first end panel and the first corner panel, but these folding lines have an offset t'. The distance t" between the score lines and the offset t' each preferably have a value in the range of T to 3T. Preferred values of t" depend on the stiffness and/or thickness of the blank material and possibly on the dimensions of the box to be assembled; for two parallel score lines a mutual distance between about T and about 2T is preferred and for three parallel score lines a mutual distance of about T is preferred.

In a still further embodiment of a blank according to the invention, the blank is made of a single piece of board having a substantially uniform thickness of 1 cm or less, and preferably a thickness less than 0.5 cm.

In a further embodiment of a blank according to the invention the blank has a length of about 2L+2.5 H+9t and a width of about W+H+6t, wherein L, W and H are the inside dimensions of a box after folding it from the blank and wherein $0 \leq t \leq 2T$, wherein T is the thickness of the blank.

In an alternative embodiment of a blank according to the invention providing a box with an overlap between respective panels the blank has a length of about 2L+2.5 H+2D+9t and a width of about W+H+2D+6t, wherein L, W and H are the inside dimensions of a box after folding it from the blank and wherein $0 \leq t \leq 2T$, wherein T is the thickness of the blank.

In a particularly advantageous embodiment of an assembly according to the invention, the tape integrally comprises tear means. Since in accordance with the invention the seam of the box (after proper folding) is situated at a single vertical height from the bottom, it is possible to easily apply a tape around the box at a reproducible defined position. In this manner, a sealing tape integrally comprising tear means can be applied to the box in a manner that it is extremely user friendly to open the box, by simply tearing the tear means, such that the seam is exposed to be manually opened by the user without much effort. Although a single tape surrounding the entire box can be used to seal the box, it is, in alternative embodiments, possible to use two or more pieces of tape to seal the box. In addition, these tapes need not necessarily surround the box completely.

The invention further relates to a box formed from any one of the embodiments of an assembly as described above, wherein the box is folded from the blank such, that the only seams, which are substantially parallel to the bottom and top plane, are a seam for attaching said first side panel to said first top side panel, a seam for attaching said second side panel to said second top side panel, and a seam for attaching said top end panel to said second end panel, wherein said seams are formed on an external surface of the box and are situated at a same distance from said bottom panel, said distance being larger than or equal to ½B, wherein the box comprises a piece of tape attaching respective panels to each other, said piece of tape integrally comprising tear means.

Further advantages, features and aspects of the invention will become apparent from the following description of different preferred embodiments of the invention in conjunction with the appended drawings. This description and the drawings depict only typical embodiments of the invention and are given as examples, which are not to be considered as limiting the scope of the invention. The drawings are not necessarily drawn to scale.

BRIEF DESCRIPTION OF THE DRAWINGS

in FIG. 5A the length dimensions and in FIG. 5B the width dimensions are indicated;

DETAILED DESCRIPTION OF EXEMPLARY EMBODIMENTS

Figure 1A:
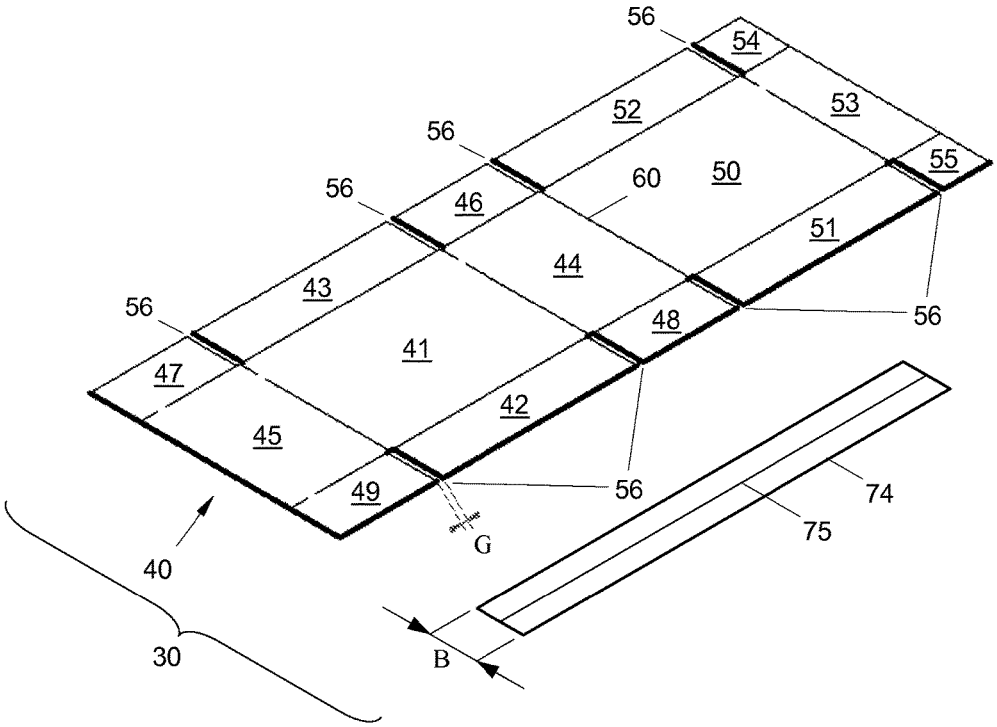
FIGS. 1A to 1E schematically show views in perspective of various stages of folding a box from an assembly of a blank and a tape in accordance with the invention.

FIGS. 1A to 1E are used to generally describe an embodiment of an assembly 30 according to the invention of a tape 74 and a blank 40 is shown schematically in views in perspective of various stages of folding a box from the blank 40. The tape 74 has a breadth B and is in this embodiment integrally provided with tear means, such as a tear strip 75. In other embodiments (not shown), the tape may alternatively be free from tear means. The blank 40 has a thickness T, and in this embodiment is manufactured from card board.

In the embodiment shown (see FIG. 1A), the blank 40 has a rectangular bottom panel 41, rectangular first and second side panels 42, 43, respectively, and rectangular first and second end panels 44, 45, respectively, joined to said bottom panel 41. Rectangular first and second corner panels 46, 48, respectively, are joined to said first end panel 44. Furthermore, rectangular third and fourth corner panels 47, 49, respectively, are joined to said second end panel 45. A rectangular top panel 50 is joined to said first end panel 44, such that it is positioned at the side of said first end panel 44 opposite to the side where said bottom panel 41 is joined to said first end panel. The blank 40 furthermore comprises rectangular first and second top side panels 51, 52, respectively, joined to said top panel 50, a rectangular top end panel 53 joined to said top panel 50 and, optionally, rectangular first and second top corner panels 54, 55, respectively joined to said top end panel 53.

Panels, which are directly joining each other, are joined by means of folding lines, such as the said end panel 44 and said top panel 50, which are joined by lid folding line 60. Each folding line can consist of a single, double or triple score lines. Please note that for sake of clarity only the lid folding line has been provided with a reference number. Neighboring panels which are indirectly joined to each other, such as said first side panel 42 and said second corner panel 48, are spaced by a cut-out 56. The cut-outs 56 between the respective corner panels and the adjoining side panels each have a length G (measured in the longitudinal direction of the blank 40) which in the shown embodiments amounts to T [shown in the figures is appr. G=T, although G=2T would be preferred], but which in other embodiments can have any value up to 4T, thus a length which is sufficient for allowing a correct folding of the panels with respect to one another. The dimensions of the respective panels will be further discussed with reference to the embodiments shown in FIGS. 5 and 6.

Figure 1B:
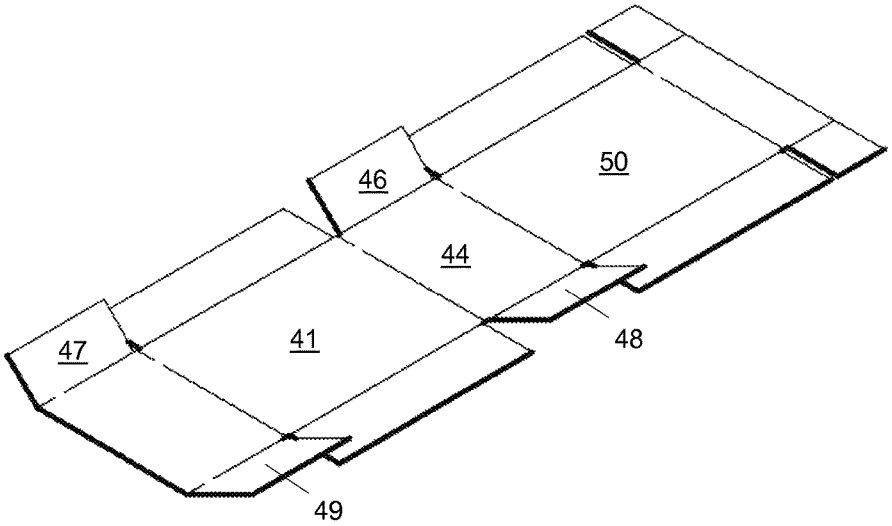
Figure 1C:
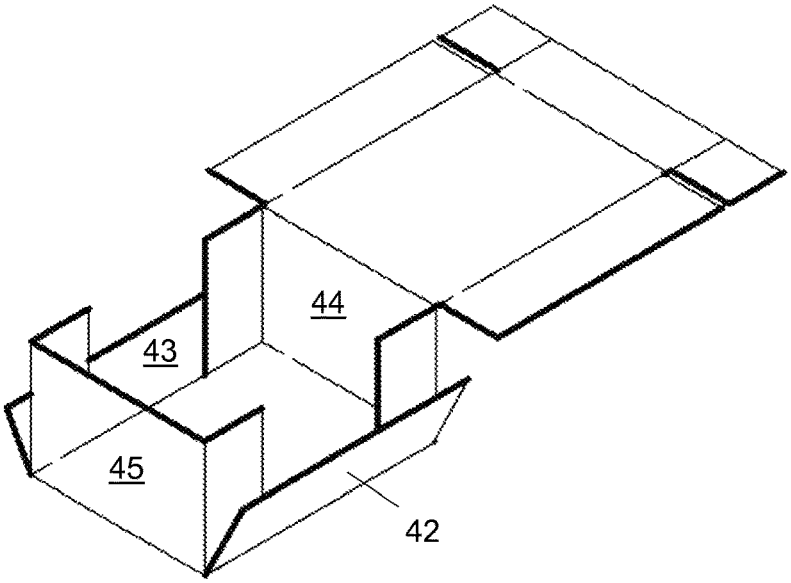
Figure 1D:
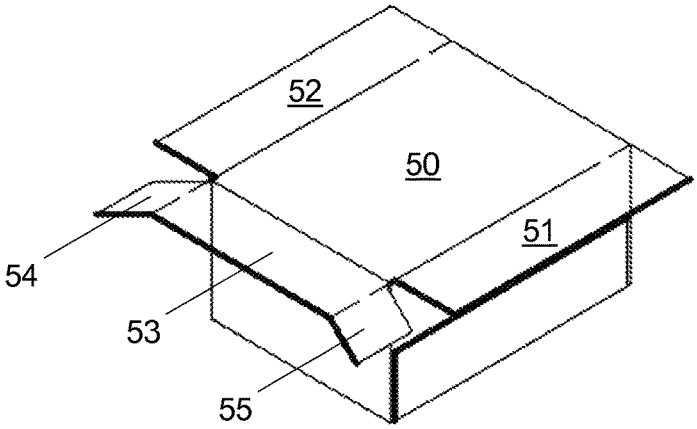
Figure 1E:
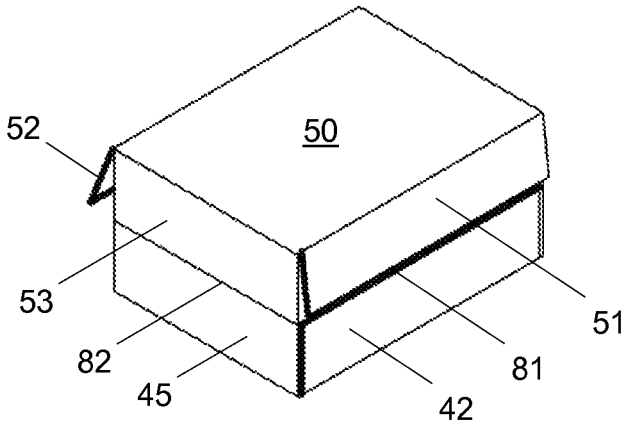
Figure 1F:
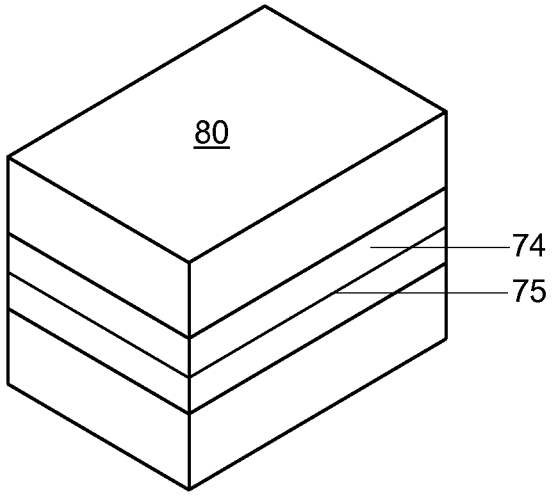
FIG. 1F schematically shows a view in perspective of a box folded from an assembly in accordance with the invention.

In FIGS. 1A-1F the different stages of folding of the blank 40 is shown, in which in FIG. 1B to 1E, only the blank 40 is shown for clarity, i.e. the tape is not shown. FIG. 1A shows the blank 40 in its flat position. In FIG. 1B, the corner panels 46, 47, 48, 49 are shown partly folded upwards. Thereafter first the end panels 44, 45 are folded upwards and then the side panels 42, 43 are folded upwards. In this situation, shown in FIG. 10, the end panels 44, 45 have been erected. Thereafter the top panel 50 is folded over, and the top corner panels 54, 55 are partly folded downwards as shown in FIG. 1D. Next, the top end panel 53 and subsequently the top side panels 51, 52 are folded downwards obtaining the custom sized, unsealed box as indicated in FIG. 1E. As a result of the dimensions of the panels as will be discussed with reference to FIGS. 5 and 6, a first seam 81 is formed between the abutting first side panel 42 and the first top side panel 51, a second seam 82 is formed by the free edge of the top end panel 53, and a third seam (not visible in FIG. 1E) is formed between the abutting second side panel 43 and second top side panel 52. As can be seen in FIG. 1E, these seams are formed on the external surface of the folded box. These three seams form the, what is called here the box seam, which can be seen as a single seam which extends around the box at a single vertical height from the bottom which is at least equal to ½B, i.e. half the breadth of the tape. This makes the application of the single tape 74 around the box to seal the box, as shown in FIG. 1F, easy, and allows for automating the sealing process. Key in the invention is that the width of the side panels (42, 43, 51 and 52) relates to the height of the box so that it is possible to fold a box which can be sealed easily with a tape in an automated way. If the box is to be sealed by a tape, one could say that the breadth B of the tape defines the minimum dimensions of the blank, in order to obtain a box that has seams along three exterior sides of the box, at a constant height with respect to the bottom plane of the assembled box, in which said height is such that the ease of closing and opening of the box are improved while the risk of untimely opening is reduced. This is an important idea of the invention for automated packaging: the breadth of the tape provided in a machine for automated packaging of items determines the minimum dimensions of the blanks used for folding boxes to package the items such that the boxes can easily be sealed by said tape.

Figure 2:
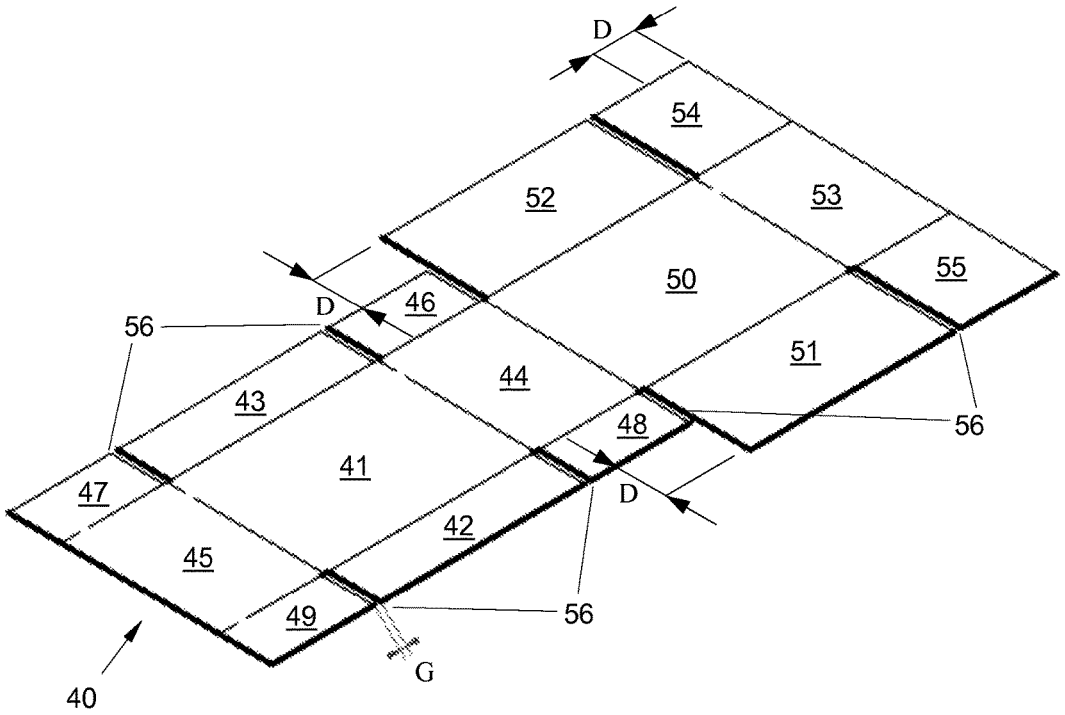
FIG. 2 schematically shows a perspective view of an alternative embodiment of a blank in accordance with the invention.

In FIG. 2 an alternative embodiment of a blank in accordance with the invention is shown in perspective. With respect to the blank shown in FIG. 1A the following dimensions are different: the width of the top side panels 51, 52 is increased with a value D, the width and length of the top corner panels 54, 55 are increased with the value D, and the length of the top end panel 53 is increased with the value D. The other dimensions remain unchanged.

Figure 3:
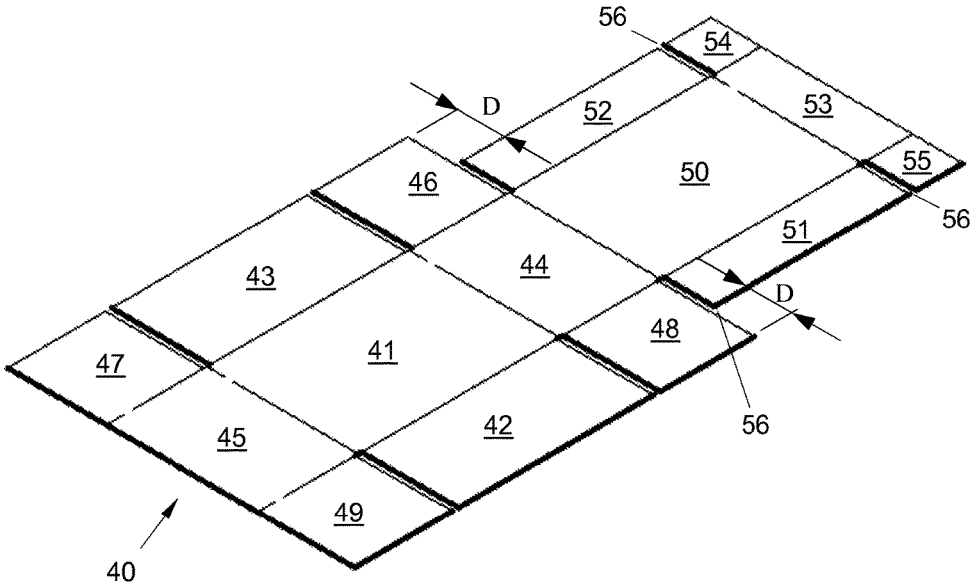
FIG. 3 schematically shows a perspective view of a further alternative embodiment of a blank in accordance with the invention.

In FIG. 3 a further alternative embodiment of a blank in accordance with the invention is shown in perspective. With respect to the blank shown in FIG. 1A the following dimensions are different: the width of the side panels 42, 43 and the width of the corner panels 46, 47, 48, 49 are increased by the value D. The other dimensions remain unchanged.

After folding the blanks according to FIGS. 2 and 3 an overlap between respective panels is obtained, however the circumference of these blanks is not rectangular. Please note that this overlap between panels improves the protection of items packaged within the box. Also with the overlap which can be obtained in these alternative embodiments the seam of the box which is to be sealed by the tape, is still positioned at a single distance of at least ½B from the edge of the box. In case the box is sealed by means of glue, which in principle is also possible, the overlap between respective panels preferably is at least 1 cm to ensure a proper sealing.

Figure 4A:
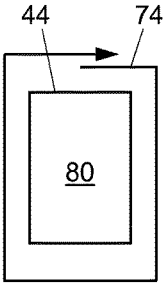
FIGS. 4A to 4D schematically show possible manners of sealing a box folded from a blank of an assembly in accordance with the invention with a tape.
Figure 4B:
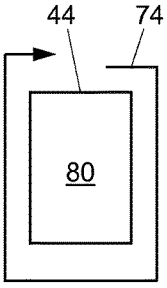
Figure 4C:
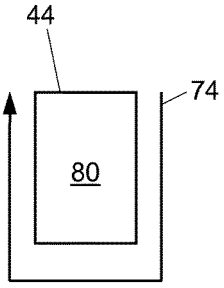
Figure 4D:
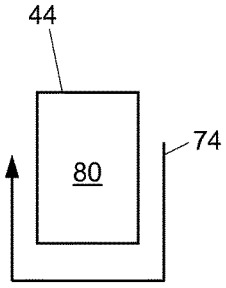

FIGS. 4A to 4D schematically show possible manners of sealing a box 80 with a tape 74. In these Figures, first end panel 44 is indicated which end panel 44 after folding does not comprise a seam and thus need not necessarily be provided with tape 74, as indicated in FIGS. 4C and 4D without detriment to the seal of the box. It is thus not necessary to completely surround the box by tape. The arrow in the drawings is indicative of the direction in which the tape is applied, but is not compulsory. In addition for sake of clarity, the tape has been depicted at a distance from the panels of the box, but it will be clear to a person skilled in the art, that the tape is attached onto the panels.

Figure 5A:
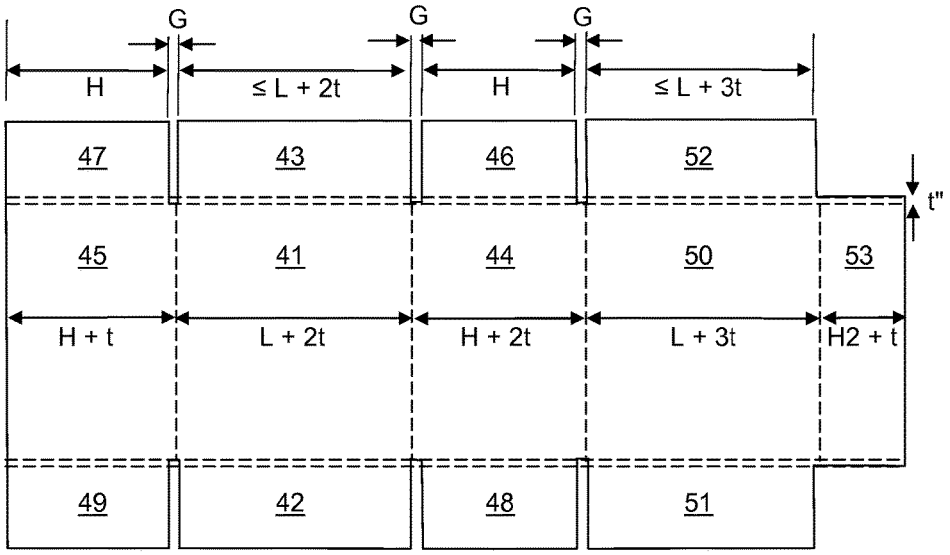
FIGS. 5A and 5B schematically show a further embodiment of a blank of an assembly in accordance with the invention, in which the side flaps abut against each other.
Figure 5B:
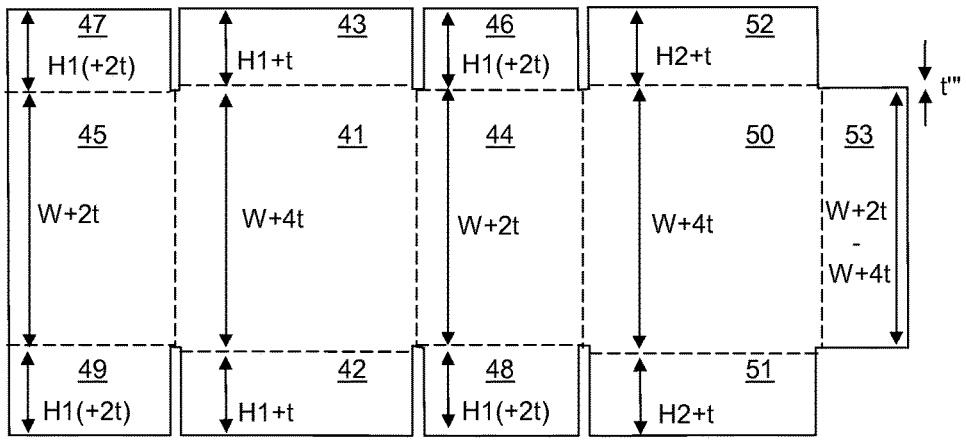
Figure 5C:
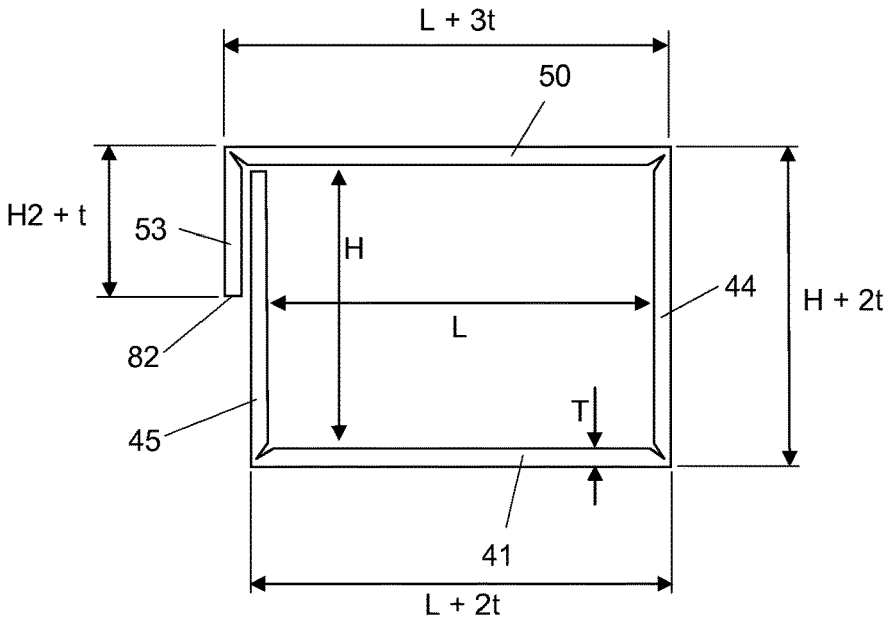
FIGS. 5C to 5E schematically show views in cross-section of a box erected from the blank shown in FIGS. 5A/B.
Figure 5D:
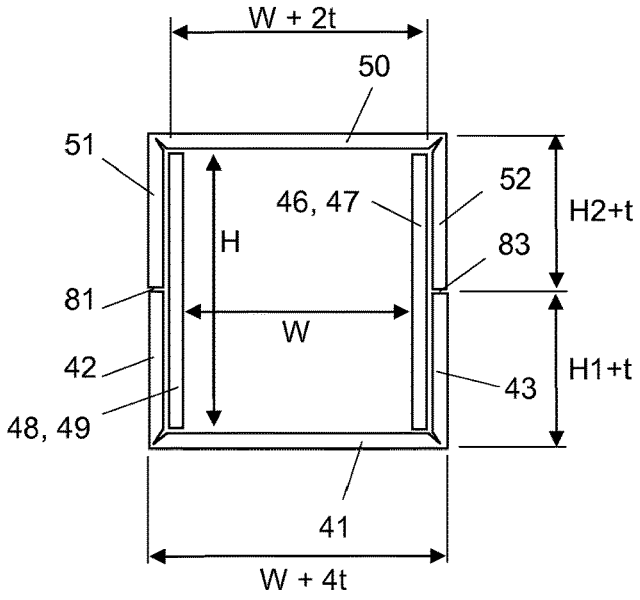
Figure 5E:
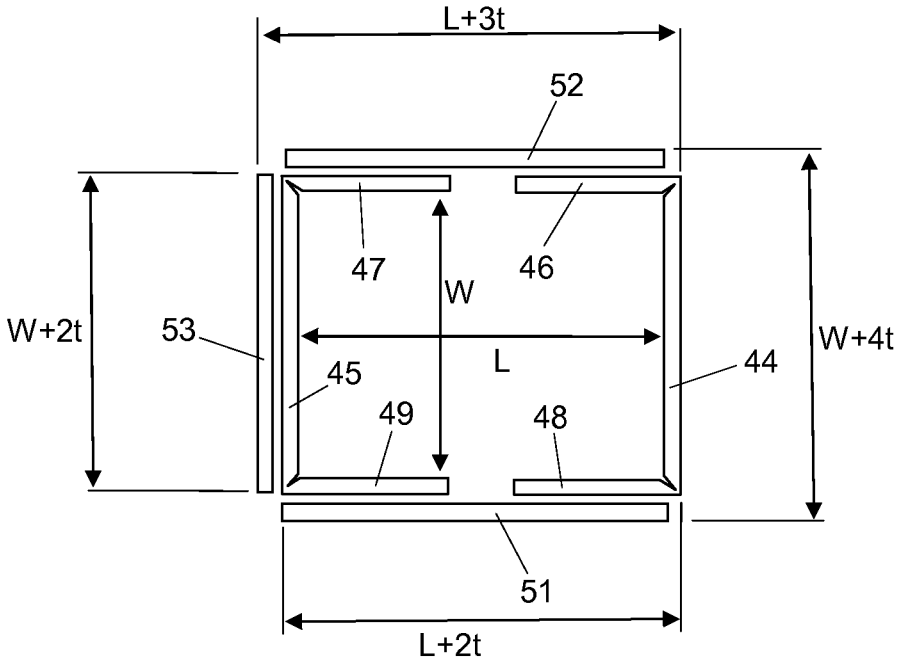

In FIGS. 5A and 5B, a further embodiment of a blank in accordance with the invention is schematically shown, in which after folding the side panels about each other. Please note that FIGS. 5A and 5B represent one and the same embodiment of a blank (apart from the different use of folding lines, as will be discussed below), but for clarity reasons in FIG. 5A, only the length dimensions and in FIG. 5B, only the width dimensions are indicated. In FIGS. 5C and 5D, side views in cross-section and in FIG. 5E, a top view in cross section of a box erected from the blank shown in FIGS. 5A/B is schematically shown in cross-section. In these FIGS. 5C to 5E, it is indicated that L is the inside length of the box, W is the inside width of the box and H is the inside height of the box. Please note that the length dimensions are measured in longitudinal direction of the blank and the width dimensions are measured in lateral direction of the blank. As before, the blank has a thickness T (indicated in FIG. 5C) and comprises a rectangular bottom panel 41.

A first rectangular side panel 42 is joined to a first side of said bottom panel 41 and a second rectangular side panel 43 is joined to a second side of said bottom panel 41 opposite the first side thereof. A first rectangular end panel 44 is joined to a first end of said bottom panel 41 and a second rectangular end panel 45 is joined to a second end of said bottom panel 41 opposite the first end of said bottom panel 41. Furthermore, a first rectangular corner panel 46 is joined to a first side of said first end panel 44 and a second rectangular corner panel 48 is joined to a second side of said first end panel 44 opposite the first side thereof. Furthermore, a third rectangular corner panel 47 is joined to a first side of said second end panel 45 and a fourth rectangular corner panel 49 is joined to a second side of said second end panel 45 opposite the first side thereof. In addition, a rectangular top panel 50 is joined to said first end panel 44 such that it is arranged at the side of said first end panel 44 opposite to the side where said bottom panel 41 is joined to said first end panel 44. A first rectangular top side panel 51 is joined to a first side of said top panel 50 and a second rectangular top side panel 52 is joined to a second side of said top panel 50 opposite the first side thereof. Finally, a rectangular top end panel 53 is joined to said top panel 50 such that it is arranged at the side of said top panel 50 opposite to the side where said first end panel 44 is joined to said top panel 50.

In the shown embodiments, the tolerance t has a value equal to the thickness T of the blank, but in dependence of amongst other things the stiffness of the material of the blank the tolerance t can have any value up to 2T, i.e. two times the thickness of the blank.

As indicated in FIGS. 5A and 5B, the rectangular bottom panel 41 has a length L+2t and a width W+4t. The rectangular side panels 42, 43 each have a length of about L+2t and a width of H1+t. The rectangular end panels 44, 45 each have a width W+2t, the first end panel 44 having a length of H+2t and the second end panel 45 having a length of H+t. The rectangular top panel 50 has a length L+3t and a width W+4t. The rectangular top side panels 51, 52 have a length of about L+3t (meaning that the length can also be slightly smaller) and a width of H2+t. The rectangular top end panel 53 has a length of H2+t and a width between W+2t and W+4t. The cut-outs between the respective corner panels and the adjoining side panels each have a length G which in the shown embodiments is about T [shown is G=T, although preferred value is G=2T], but which length G in other embodiments could have any value up to 4T, thus a length which is sufficient for allowing a correct folding of the panels with respect to one another.

In embodiments where the dimensions H1 and H2 are equal (H1=H2), a rectangular blank as shown in FIG. 1A is obtained. In embodiments where H1=H2=½H after erecting the box, the respective panels abut against each other as indicated in FIG. 1E. In embodiments where H1=H2=½H+D, after folding the box, an overlap of 2D between panels is created which overlap improves protection of items packaged within the box. In embodiments where either H1 or H2 equals ½H+D, after folding the box, an overlap of D between panels is created, which overlap improves protection of items packaged within the box. In the embodiments of FIG. 5, the values of H−H1 and/or H−H2 are equal to or greater than 1 cm, preferably 2 cm, most preferably 3 cm. Thus also with an overlap, the seam of the box which is to be sealed by the tape is still positioned at a distance of at least 1 cm from the edge of the box. In all these embodiments, L is greater than or equal to ½H.

In FIG. 5A, an embodiment is indicated in which the longitudinal folding lines comprise two parallel score lines which are spaced at a distance t" from each other, which distance in the shown embodiments equals T, but which distance t" in other embodiments could have any value up between T and 3T and in which the lateral folding lines consists of a single score line. In the embodiment shown in FIG. 5B, all the folding lines consist of single score lines, but the longitudinal score lines are offset relative to one another with a distance t'" as indicated in the Figure, which distance t'" in the shown embodiments equals T, but in other embodiments could have any value up between T and 3T.

Figure 6A:
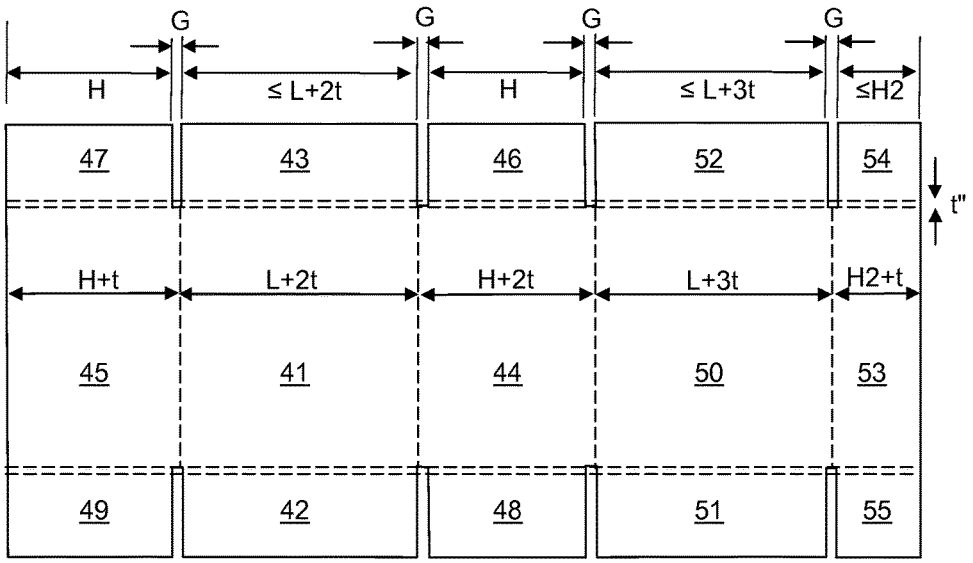
FIGS. 6A and 6B schematically show a further embodiment of a blank in accordance with the invention in which the side flaps abut against each other, in which in FIG. 6A the length dimensions and in FIG. 6B the width dimensions are indicated.
Figure 6B:
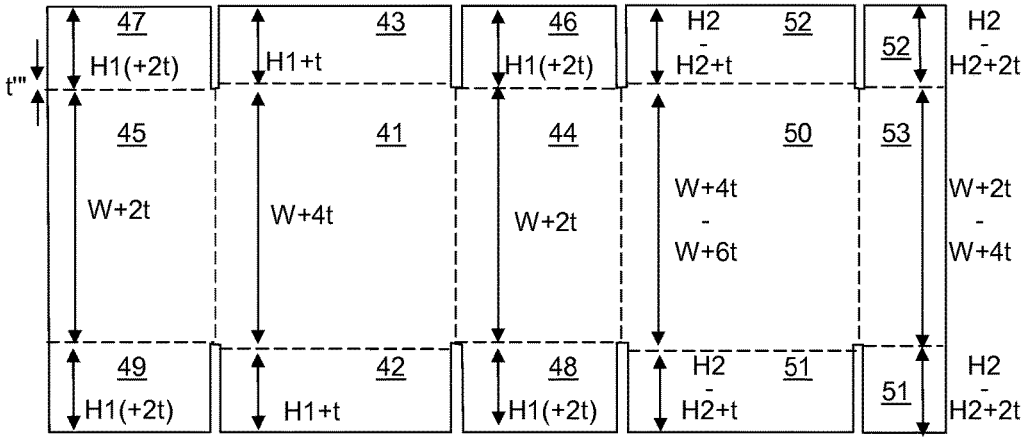
Figure 6C:
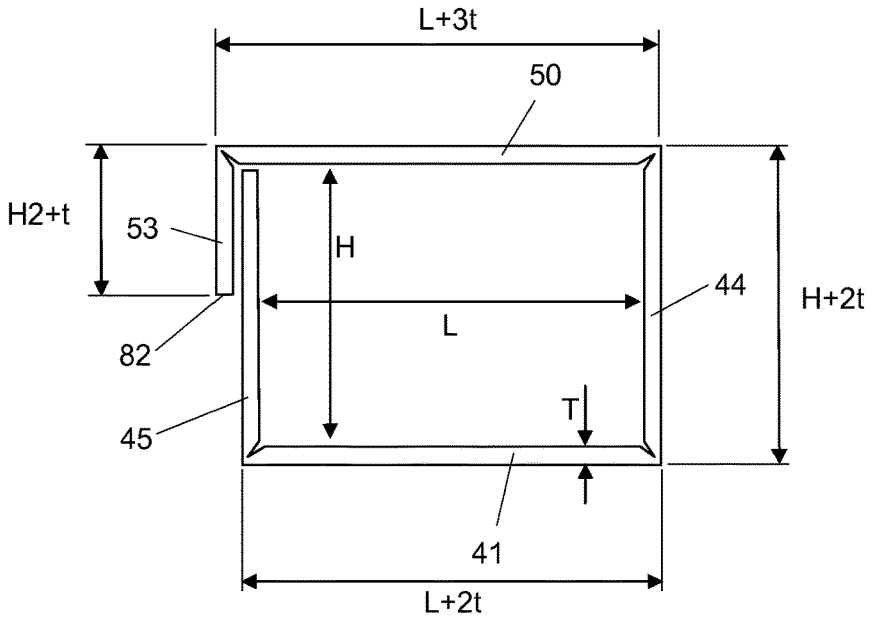
FIGS. 6C to 6E schematically show views in cross-section of a box erected from the blank shown in FIGS. 6A/B.
Figure 6D:
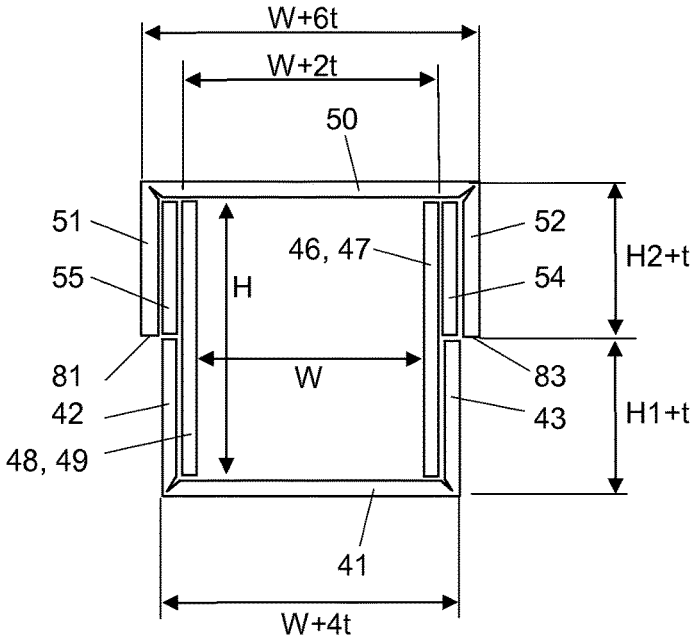
Figure 6E:
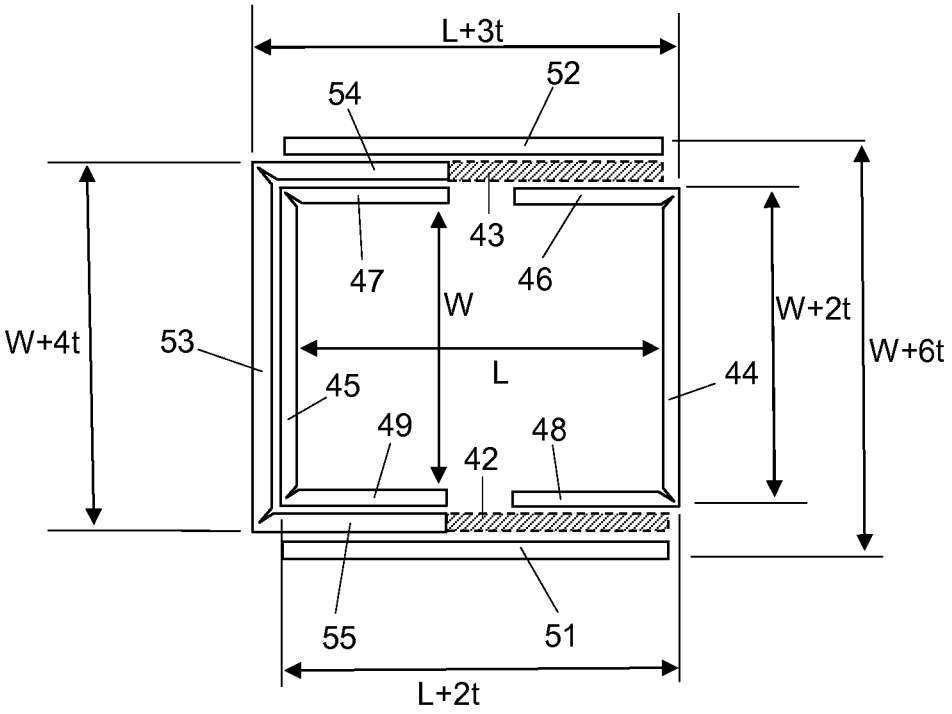

In FIGS. 6A and 6B, a further embodiment of a blank in accordance with the invention is schematically shown, in which after folding the side panels abut against each other. Please note that the FIGS. 6A and 6B represent one and the same embodiment of a blank (apart from the different use of folding lines, as will be discussed below), but for clarity reasons in FIG. 6A, only the length dimensions and in FIG. 6B, only the width dimensions are indicated. In FIGS. 6C and 6D, side views in cross-section and in FIG. 6E, a top view in cross-section of a box erected from the blank shown in FIGS. 6A/B is schematically shown in cross-section. In these FIGS. 6C to 6E, it is indicated that L is the inside length of the box, W is the inside width of the box and H is the inside height of the box. Please note that the length dimensions are measured in longitudinal direction of the blank and the width dimensions are measured in lateral direction of the blank. As before the blank has a thickness T (indicated in FIG. 6C) and comprises a rectangular bottom panel 41.

A first rectangular side panel 42 is joined to a first side of the rectangular bottom panel 41 and a second rectangular side panel 43 is joined to a second side of the rectangular bottom panel 41 opposite the first side thereof. A first rectangular end panel 44 is joined to a first end of said bottom panel 41 and a second rectangular end panel 45 is joined to a second end of said bottom panel 41 opposite the first end of said bottom panel 41.

A first rectangular corner panel 46 is joined to a first side of said first end panel 44 and a second rectangular corner panel 48 is joined to a second side of said first end panel 44 opposite the first side thereof. Furthermore, a third rectangular corner panel 47 is joined to a first side of said second end panel 45 and a fourth rectangular corner panel 49 is joined to a second side of said second end panel 45 opposite the first side thereof. A rectangular top panel 50 is joined to said first end panel 44 such that it is arranged at the side of said first end panel 44 opposite to the side where said bottom panel 41 is joined to said first end panel 44.

A first rectangular top side panel 51 is joined to a first side of said top panel 50 and a second rectangular top side panel 52 is joined to a second side of said top panel 50 opposite the first side thereof. Furthermore, a rectangular top end panel 53 is joined to said top panel 50 such that it is arranged at the side of said top panel 50 opposite to the side where said first end panel 44 is joined to said top panel 50. When compared with the embodiment of the blank shown in FIG. 5, the blank according to FIG. 6 further comprises a first rectangular top corner panel 54 joined to a first side of said top end panel 53 and a second rectangular top corner panel 54 joined to a second side of said top end panel 53 opposite the first side thereof.

In the embodiment of FIGS. 6A to D, said bottom panel 41 has a length L+2t and a width W+4t. Said side panels 42, 43 each have a length of about L+2t (meaning that the dimension can also be slightly smaller) and a width of H1+t. Said end panels 44, 45 each have a width W+2t. Said first end panel 44 has a length of H+2t, while said second end panel 45 has a length of H+t. Said top panel 50 has a length L+3t and a width between W+4t and W+6t. Said top side panels 51, 52 have a length of about L+3t (meaning that the dimension can also be slightly smaller) and a width between H2 and H2+t. Said top end panel 53 has a length of about H2 (meaning that the dimension can also be slightly smaller) and a width between W+2t and W+4t. Said top corner panels 54, 55 each have a length of about H2 and a width between H2 and H2+2t.

In particular embodiments of FIG. 6, the dimensions H1 and H2 are equal (H1=H2) such that a rectangular blank as shown in FIG. 1A is obtained. In embodiments where H1=H2=½H after erecting the box the respective panels abut against each other as indicated in FIG. 1E. In embodiments where H1=H2=½H+D, after folding the box, an overlap of 2D between panels is created which overlap improves protection of items packaged within the box. In embodiments, where either H1 or H2 equals ½H+D, after folding the box, an overlap of D between panels is created, which overlap improves protection of items packaged within the box. In the embodiment of FIG. 6, the values of H−H1 and/or H−H2 are equal to or greater than 2 cm, preferably 3 cm. Thus also with an overlap the seam of the box which is to be sealed by the tape is still positioned at a distance of at least 2 cm from the edge of the box. In all these embodiments, L is greater than or equal to ½H. This is preferred to make said corner panels 46, 47, 48 and 49, and if present, said top corner panels 54 and 55, fit within the box without requiring additional folds.

In FIG. 6A, an embodiment is indicated in which the longitudinal folding lines comprise two parallel score lines which are spaced at a distance t from each other, and in which the lateral folding lines consists of a single score line. In the embodiment shown in FIG. 6B, all the folding lines consist of single score lines, but the longitudinal score lines are offset relative to one another as indicated in the Figure.

The invention claimed is:

1. A blank for a box, said blank having:

a rectangular bottom panel, a first rectangular side panel joined to a first side of said bottom panel, a second rectangular side panel joined to a second side of said bottom panel opposite the first side thereof, a first rectangular end panel joined to a first end of said bottom panel, a second rectangular end panel joined to a second end of said bottom panel opposite the first end of said bottom panel and having a free end side opposite said second end of said bottom panel, a first rectangular corner panel joined to a first side of said first end panel, a second rectangular corner panel joined to a second side of said first end panel opposite the first side thereof, a third rectangular corner panel joined to a first side of said second end panel, a fourth rectangular corner panel joined to a second side of said second end panel opposite the first side thereof, a rectangular top panel joined to said first end panel such that it is arranged at the side of said first end panel opposite to the side where said bottom panel is joined to said first end panel, a first rectangular top side panel joined to a first side of said top panel, a second rectangular top side panel joined to a second side of said top panel opposite the first side thereof, and a rectangular top end panel joined to said top panel such that it is arranged at the side of said top panel opposite to the side where said first end panel is joined to said top panel, wherein each of a respective width of each of said top side panels and a length of said top end panel is less than a length of the first end panel, wherein the length of said first end panel is approximately equal to a length of said second end panel; and wherein the length of said top end panel is less than the length of the first end panel.

2. A blank according to claim 1, wherein said first and second side panels each have a width that is less than the length of the first end panel, wherein the width of the first side panel together with the width of the first top side panel at least substantially corresponds to the length of the first end panel and wherein the width of the second side panel together with the width of the second top side panel at least substantially corresponds to the length of the first end panel.

3. A blank according to claim 1, wherein said bottom panel has a length of about L+2t and a width of about W+4t, said side panels each have a length ranging from about L to about L+2t, said end panels each have a width of about W+2t, said first end panel has a length of about H+2t, said second end panel has a length of about H+t, said top panel has a length of about L+3t and a width of about W+4t, said top side panels each have a length ranging from about L+t to about L+3t, said top end panel has a width between about W+2t and about W+4t, and wherein L is the inside length of the box to be folded from the blank, W is the inside width of the box to be folded from the blank, H is the inside height of the box to be folded from the blank, t is a tolerance value satisfying the relation $0 \leq t \leq 2T$, and T is the thickness of the blank.

4. A blank according to claim 3, wherein said side panels each have a width of about H1+t, said top side panels each have a width of about H2+t, said top end panel has a length of about H2+t, and wherein H2+H1≥H.

5. A blank according to claim 3, wherein said blank has a length of about 2L+2.5 H+9t and a width of about W+H+6t.

6. A blank according to claim 1, wherein the first and second rectangular top side panels each have a width that together with a distance D substantially corresponds to the length of the first end panel, and wherein the top end panel has a length that together with a distance D substantially corresponds to the length of the first end panel, wherein D<6 cm, preferably D is at least about 1 cm, and most preferably at least about 3 CM.

7. A blank according to claim 1, said blank further having a first rectangular top corner panel joined to a first side of the top end panel and a second rectangular top corner panel joined to a second side of the top end panel opposite the first side thereof.

8. A blank according to claim 7, wherein said bottom panel has a length of about L+2t and a width of about W+4t, said side panels each have a length ranging from about L to about L+2t, said end panels each have a width of about W+2t, said first end panel has a length of about H+2t, said second end panel has a length of about H+t, said top panel has a length of about L+3t and a width ranging from about W+4t to about W+6t, said top side panels each have a length ranging from about L+t to about L+3t, said top end panel has a width between about W+2t and about W+4t, and wherein L is the inside length of the box to be folded from the blank, W is the inside width of the box to be folded from the blank, H is the inside height of the box to be folded from the blank, t is a tolerance value satisfying the relation $0 \leq t \leq 2T$, and T is the thickness of the blank.

9. A blank according to claim 8, wherein said side panels each have a width of about H1+t, said top side panels each have a width of about H2+t, said top end panel has a length of about H2+t, and wherein H2+H1≥H.

10. A blank according to claim 1, wherein said blank is made of a single piece of board having a substantially uniform thickness of 1 cm or less, and preferably a thickness less than 0.5 cm.

11. A blank according to claim 1, wherein said blank is rectangular.

12. A blank according to claim 1, wherein respective panels of said blank which are directly joined to each other are joined by folding lines, and wherein each of the folding lines connecting neighboring panels is formed of at least one score line, preferably two or three parallel score lines, which are spaced at a mutual distance of t", wherein t" has a value in the range of about T to 3T.

13. An assembly of a blank according to claim 1 and a tape for sealing a box to be folded from the blank, the tape having a breadth B.

14. An assembly according to claim 13, wherein said bottom panel has a length of about L+2t and a width of about W+4t, said side panels each have a length ranging from about L to about L+2t and a width of about H1+t, said end panels each have a width of about W+2t, said first end panel has a length of about H+2t, said second end panel has a length of about H+t, said top panel has a length of about L+3t and a width ranging from about W+4t to about W+6t, said top side panels each have a length ranging from about L+t to about L+3t and a width of about H2+t, said top end panel has a length of about H2+t and a width between about W+2t and about W+4t, and wherein H2=½H and/or H1=½H and H H2=½B and/or H H1=½B, L is the inside length of the box to be folded from the blank, W is the inside width of the box to be folded from the blank, H is the inside height of the box to be folded from the blank, B is the breadth of the tape, t is a tolerance value satisfying the relation $0 \leq t \leq 2T$, and T is the thickness of the blank.

15. An assembly according to claim 13, wherein the tape integrally comprises a tear strip.

16. A box formed from a blank according to claim 1.

17. A box according to claim 16, wherein the box is folded such from the blank that the only seams substantially parallel to the bottom and top plane are a seam for attaching the first side panel to the first top side panel, a seam for attaching the second side panel to the second top side panel, and a seam for attaching the top end panel to the second end panel, wherein the seams are formed on an external surface of the box and are situated at a same distance from the bottom panel.

18. A box according to claim 16 sealed by a tape having a breadth B, wherein said distance, at which the seams are situated from the bottom panel, is larger than or equal to ½B.

19. A blank according to claim 1 wherein the length of the top end panel is no longer than the width of each of said top side panels plus the width of the tape.

20. A blank for a box, said blank having:

a rectangular bottom panel, a first rectangular side panel joined to a first side of said bottom panel, a second rectangular side panel joined to a second side of said bottom panel opposite the first side thereof, a first rectangular end panel joined to a first end of said bottom panel, a second rectangular end panel joined to a second end of said bottom panel opposite the first end of said bottom panel and having a free end side opposite said second end of said bottom panel, a first rectangular corner panel joined to a first side of said first end panel, a second rectangular corner panel joined to a second side of said first end panel opposite the first side thereof, a third rectangular corner panel joined to a first side of said second end panel, a fourth rectangular corner panel joined to a second side of said second end panel opposite the first side thereof, a rectangular top panel joined to said first end panel such that it is arranged at the side of said first end panel opposite to the side where said bottom panel is joined to said first end panel, a first rectangular top side panel joined to a first side of said top panel, a second rectangular top side panel joined to a second side of said top panel opposite the first side thereof, and a rectangular top end panel joined to said top panel such that it is arranged at the side of said top panel opposite to the side where said first end panel is joined to said top panel, wherein each of a respective width of each of said top side panels and a length of said top end panel is less than a length of the first end panel, wherein the length of the first end panel is about $H+2t$, a length of the second end panel is about $H+t$, H is an inside height of the box to be folded from the blank, t is a tolerance value satisfying the relation $0 \leq t \leq 2T$, and T is a thickness of the blank; and wherein the length of said top end panel is less than the length of the first end panel.

* * * * *